US005524589A

United States Patent [19]

Kikkawa et al.

[11] Patent Number: 5,524,589

[45] Date of Patent: Jun. 11, 1996

[54] THROTTLE CONTROL APPARATUS

[75] Inventors: Mitsuo Kikkawa; Masaru Shimizu; Yoshinori Taguchi; Tomomitsu Terakawa, all of Aichi, Japan

[73] Assignee: Aisin Seiki Kabushiki Kaisha, Kariya, Japan

[21] Appl. No.: 343,904

[22] Filed: Nov. 17, 1994

[30] Foreign Application Priority Data

Nov. 19, 1993 [JP] Japan ..... 5-291060

[51] Int. Cl.[6] ..... F02D 7/00

[52] U.S. Cl. ..... 123/396

[58] Field of Search ..... 123/396, 399, 123/400

[56] References Cited

U.S. PATENT DOCUMENTS

| | | | |
|---|---|---|---|
| 5,048,484 | 9/1991 | Terazawa et al. | 123/396 |
| 5,065,722 | 11/1991 | Huber et al. | 123/396 |
| 5,131,362 | 7/1992 | Simon et al. | 123/396 |
| 5,172,667 | 12/1992 | Spiegel | 123/396 |

FOREIGN PATENT DOCUMENTS

| | | |
|---|---|---|
| 59-122742 | 7/1984 | Japan . |
| 4-231627 | 8/1992 | Japan . |

*Primary Examiner* Noah P. Kamen

*Attorney, Agent, or Firm* Burns, Doane, Swecker & Mathis

[57] ABSTRACT

A throttle control apparatus carries out electronic throttle control, wherein a throttle valve is opened and closed by a motor actuated in accordance with depression of an accelerator pedal. It includes an accelerator lever actuated by the accelerator pedal, a throttle lever provided with the throttle valve, a motor lever actuated by the motor so as to operate the throttle lever in a valve-opening direction and in a valve-closing direction, a limp home lever, and an urging spring for urging the motor lever and the throttle lever in the valve-closing direction. The limp home lever is held rotatably on the throttle lever so as to rotate to an engagement position where it can mechanically engage with the accelerator lever and to a siding position where it cannot mechanically engage therewith. The urging spring also actuates the limp home lever so as to rotate to the siding position when electronic throttle control is carried out by the motor, and actuates it so as to rotate to the engagement position when electronic throttle control is not carried out by the motor.

18 Claims, 7 Drawing Sheets

( PRIOR ART )

THROTTLE CONTROL APPARATUS

BACKGROUND OF THE INVENTION

1. Field of the Invention

The present invention relates to a throttle control apparatus which controls, in accordance with the depression of an accelerator pedal, a motor so as to open and close a throttle valve by means of a controller, thereby controlling the amount of inlet air fed to an internal combustion engine.

2. Description of Related Art

A throttle control apparatus has been developed recently in which an electronic throttle control is carried out. For instance, a motor is actuated by a controller in accordance with depression of an accelerator pedal, and a throttle valve is opened and closed accordingly.

Japanese Unexamined Patent Publication (KOKAI) No. 4-231,627 discloses one such throttle control apparatus. In this throttle control apparatus, a motor is actuated in accordance with the depression of an accelerator pedal and a throttle valve is electrically controlled during ordinary driving. On the other hand, when the motor is turned off due to a failure in the electric system, an electromagnetic clutch is actuated to mechanically engage the accelerator lever and the throttle lever, thereby opening the throttle valve in accordance with the depression of the accelerator pedal. Thus, with this throttle control apparatus, it is possible to drive the vehicle to a repair shop even when the motor is turned off as a result of a failure in the electric system or the like.

However, the throttle control apparatus disclosed in the aforementioned publication requires the electromagnetic clutch, The electromagnetic clutch must be connected to an electric power source so as to apply a predetermined voltage thereto even during ordinary driving. This is problematic in that it requires a large electric power consumption.

Japanese Unexamined Patent Publication (KOKAI) No. 59-122,742 discloses another throttle control apparatus. As illustrated in FIG. 8, in this throttle control apparatus, a motor 502 is actuated in accordance with signals output by an accelerator sensor 501 which detects the depression of an accelerator pedal 500, a motor pulley 503 is rotated in the direction of the arrow P1 of the drawing, and consequently a throttle valve 506 is electrically controlled by way of a cable 504 during ordinary driving. On the other hand, when the motor 502 is turned off due to a failure in the electric system, an accelerator pulley 507 is rotated by way of a cable 508, in accordance with the depression of the accelerator pedal 500, in the direction of the arrow P1 of the drawing so as to mechanically engage its protrusion plate **507*a* with a protrusion plate 503*a* of the motor pulley 503. The motor pulley 503 is rotated in the same direction (i.e., in the direction of the arrow P1), and consequently the throttle valve 506 is opened by way of the cable 504. In this throttle control apparatus, the protrusion plate 503*a* and the protrusion plate 507*a* are off-set or separated from each other in the circumferential direction. The off-set distance between them inhibits the protrusion plates 503*a* and 507*a*** from engaging each other.

However, when controlling a driving vehicle, situations arise where the throttle valve 506 should be controlled so as to operate in the valve-closing direction regardless of the depression of the accelerator pedal 500. This type of control is generally called traction control (hereinafter simply referred to as "TRC" control), and, for instance, is intended to prevent vehicles from slipping during starting or driving on iced roads. When such TRC control is carried out, although the accelerator pulley 507 is rotated in the direction of the arrow P1 because of the depression of the accelerator pedal 507, the motor pulley 503 is rotated by the motor 502 in the direction of the arrow P2. As a result, the protrusion plate **503*a* mechanically engages the protrusion 507a, and accordingly there arises difficulty with respect to controlling the throttle valve 506 in the valve-closing direction. In addition, the mechanical engagement between the protrusion plates 503*a* and 507*a* causes shock in the accelerator pedal 500. In order to overcome these problems, it is necessary to increase the off-set distance between the protrusion plates 503*a* and 507*a*, but this inevitably leads to a larger throttle control apparatus. Further, even if the off-set distance between the protrusion plates 503*a* and 507*a* can be increased in the circumferential direction in order to prevent the protrusion plates 503*a* and 507*a* from mechanically engaging each other, the protrusion plate 507*a* must be rotated by the increased off-set distance in the direction of the arrow P1 when the motor 502 is turned off. Consequently, there arises another problem in that, when the motor 502 is turned off, the degree of opening of the throttle valve 506** is restricted and can hardly be increased.

As can be appreciated from the foregoing description, in the throttle control apparatus disclosed in Japanese Unexamined Patent Publication (KOKAI) No. 59-122,742 and illustrated in FIG. 8, the protrusion plate **503*a* and the protrusion plate 507*a* are separated from each other in the circumferential direction to a certain extent, and are disposed to face each other when electronic throttle control is carried out by utilizing the motor 502. However, they cannot be shunted to their siding positions when electronic throttle control is carried out by utilizing the motor 502**.

SUMMARY OF THE INVENTION

The present invention has been developed in view of the aforementioned circumstances. It is therefore a first object of the present invention to provide a throttle control apparatus which can obviate the problems associated with a conventional electromagnetic clutch so that when electronic throttle control is employed, through actuation of a throttle valve with a motor controlled by a controller, a limp home lever is actively shunted to a siding position so as to advantageously solve a problem of a mechanically engaged limp home lever during TRC control.

It is a second object of the present invention to provide a throttle control apparatus which can regulate the positions of a limp home lever and which can further advantageously solve the problem of a mechanically engaged limp home lever.

Moreover, when a motor is of unfavorable responsibility and when an accelerator pedal is depressed abruptly, a limp home lever and an accelerator lever might engage with each other on rare occasions. It is the following third, fourth and fifth objects of the present invention to address this problem.

It is therefore a third object of the present invention to provide a throttle control apparatus which, even when such an engagement is about to occur, can avoid the engagement and satisfactorily carry out TRC control.

It is therefore a fourth object of the present invention to provide a throttle control apparatus which can advantageously avoid the engagement between a limp home lever and an accelerator lever when an accelerator pedal is abruptly depressed.

It is therefore a fifth object of the present invention to provide a throttle control apparatus which, even when a limp home lever engages with an accelerator lever, can advantageously increase the valve opening speed of a throttle valve by utilizing the engagement.

In a first aspect of the present invention, a throttle control apparatus that carries out electronic throttle control through opening and closing of a throttle valve by a motor actuated in accordance with the depression of an accelerator pedal, includes: an accelerator lever actuated in accordance with depression of the accelerator pedal, a throttle lever provided with the throttle valve, and a motor lever actuated by the motor so as to operate the throttle lever in a valve-opening direction and in a valve-closing direction. A limp home lever includes an engager capable of engaging with the accelerator lever and is held rotatably on the throttle lever so as to rotate to an engagement position where the engager can mechanically engage the accelerator lever and to a siding position where the engager cannot mechanically engage with said accelerator lever. A device is provided for urging the motor lever and the throttle lever in the valve-closing directions, and for actuating the limp home lever to rotate to the siding position when electronic throttle control is carried out by the motor, and actuating the limp home lever to rotate to the engagement position to mechanically engage the engager of the limp home lever with the accelerator lever when electronic throttle control is not carried out by the motor, thereby interlocking operation of the throttle lever with operation of the accelerator pedal.

In the first aspect of the present invention, the urging device can be a spring or a plurality of springs disposed parallel each other. In a second aspect of the present invention, the limp home lever includes a regulatee formed of one member selected from the group consisting of concavity and convexity, and the motor lever includes a position regulator formed of another one member selected from the group consisting of concavity and convexity, thereby positionally regulating the limp home lever by holing the regulatee with the position regulator.

In a third aspect of the present invention, the present throttle control apparatus further includes a traction-control demand detecting device for detecting the demand of traction control, and a motor temporarily-controlling device for temporarily actuating the motor in the valve-opening direction and thereafter actuating the motor in the valve-closing direction when traction control is demanded, when the accelerator pedal is abruptly depressed and when the limp home lever engages the accelerator lever.

In a fourth aspect of the present invention, the present throttle control apparatus further includes a motor-output increasing device for increasing the output of the motor when the accelerator pedal is abruptly depressed and when the limp home lever engages the accelerator lever. In the fourth aspect of the present invention, the motor-output increasing device can be constituted by a micro-computer loaded with software.

In a fifth aspect of the present invention, the accelerator lever is further capable of auxiliarily helping the opening of the throttle valve, controlled by the motor, when the accelerator pedal is abruptly depressed and when the limp home lever engages the accelerator lever.

In the first aspect of the invention, the limp home lever is at the siding position during ordinary driving or when electronic throttle control, utilizing a motor controlled by a controller, is carried out. Accordingly, the engager of the limp home lever is inhibited from mechanically engaging the accelerator lever.

On the contrary, when the electronic throttle control is not carried out, for instance, when the motor is not actuated due to failures in the electric system, the limp home lever is at the engagement position. Namely, when the accelerator lever is depressed and the accelerator lever is actuated, the accelerator lever engages the engager of the limp home lever. Consequently, the throttle valve is opened in accordance with depression of the accelerator pedal. Hence, in accordance with the first aspect of the present invention, the limp home lever can be actively shunted to the siding position when the electronic throttle control is carried out. Thus, the first aspect of the present invention can advantageously solve the problems associated with the mechanically engaged limp home lever which might occur during TRC control, and can also obviate the conventional electromagnetic clutch.

Further, in the first aspect invention, the limp home lever can be provided with a first engager capable of engaging with the accelerator lever and a second engager capable of engaging with the motor lever, and shunting means and spring can be further included therein. If such is the case, when the motor lever is actuated, the limp home lever is rotated by the shunting means so as not to engage its first engager with the accelerator lever. Accordingly, the throttle lever is operated by the motor lever only. When the motor is turned off, e.g., when the motor is not under control or when the motor is turned off due to failures in an electronic system, the motor lever is actuated by the spring to engage with the second engager of the limp home lever, and the limp home lever is rotated to the engagement position. Consequently, the throttle lever can be operated by the accelerator lever.

In the second aspect of the invention, the regulatee of the limp home lever and the position regulator of the motor lever restrict the positions of the limp home lever. Accordingly, the limp home lever is inhibited from moving unnecessarily. Therefore, in accordance with the second aspect of the invention, it is possible to securely inhibit the limp home lever from engaging with the accelerator lever when the engagement is not required.

In the third aspect of the present invention, when the accelerator pedal is depressed abruptly and even when the limp home lever engages with the accelerator lever, the motor is temporarily actuated in the valve-opening direction. Accordingly, the engagement is canceled, and, after canceling the engagement, the motor is actuated in the valve-closing direction. Thus, the throttle valve is eventually actuated in the closing direction to decrease its opening degree. In accordance with the third aspect of the present invention, traction control can be carried out normally.

In the fourth aspect of the present invention, the motor-output increasing device increases output of the motor when the accelerator pedal is abruptly depressed and when the limp home lever engages with the accelerator lever. Thus, the motor can be improved in terms of responsibility. In accordance with the fourth aspect of the present invention, it is possible to use a motor of small rating.

In the fifth aspect of the present invention, when the accelerator pedal is abruptly depressed and when the limp home lever engages with the accelerator lever, the motor is actuated in the valve-opening direction while keeping the engagement between the limp home lever and the accelerator lever. Thus, the throttle valve can be enhanced in terms of valve-opening speed. In accordance with the fifth aspect of the present invention, even when a motor of unfavorable responsibility is employed, it is possible to increase opening speed of the throttle valve.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Figure 1:
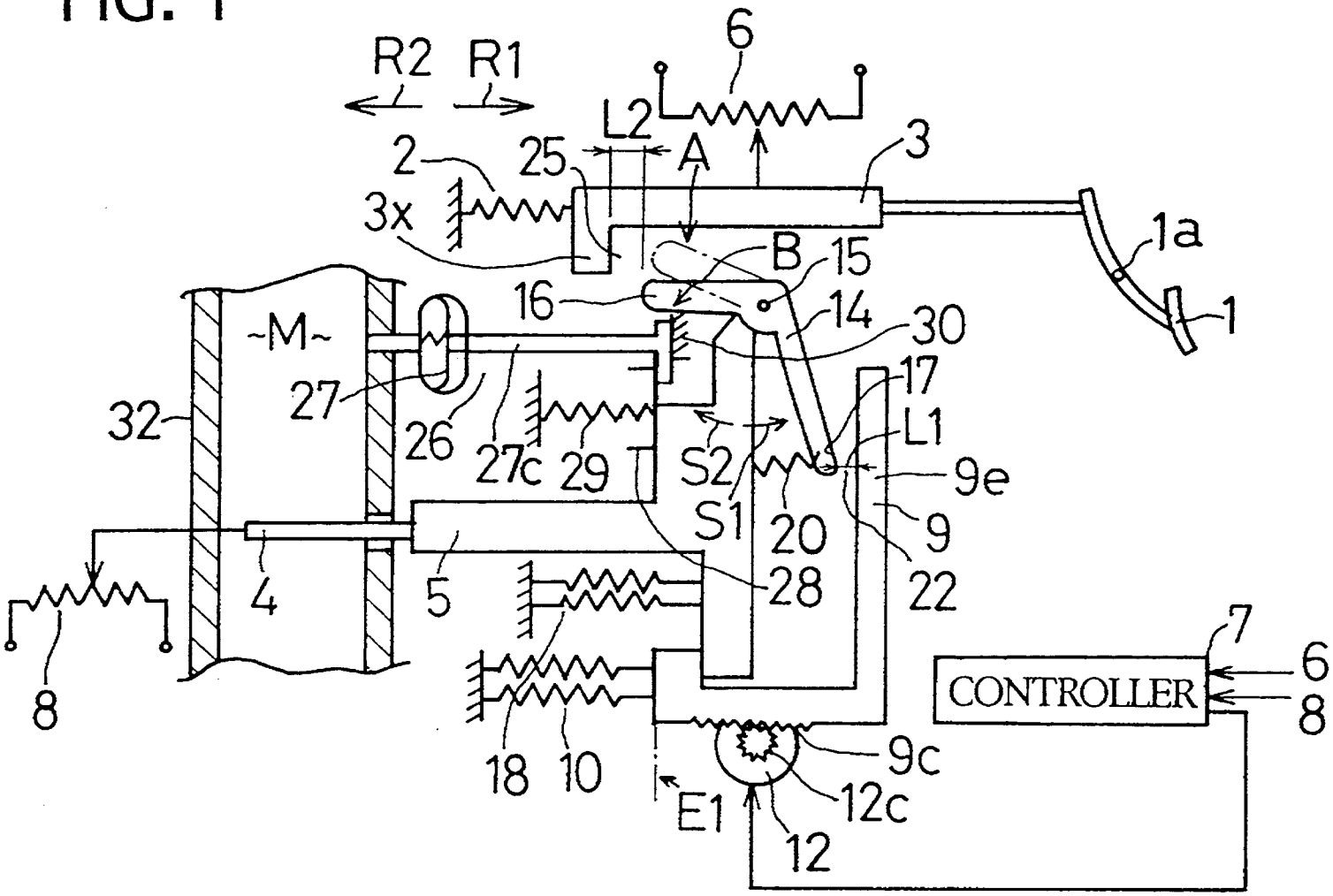
FIG. 1 is a diagram for illustrating principles of the present invention as well as a First Preferred Embodiment of a throttle control apparatus according to the present invention.

Having generally described the present invention, a further understanding can be obtained by reference to the specific preferred embodiments which are provided herein for purposes of illustration only and are not intended to limit the scope of the appended claims.

First Preferred Embodiment

A First Preferred Embodiment of a throttle control apparatus according to the present invention will be hereinafter described with reference to FIG. 1 which also illustrates principles of the present invention, In order to help facilitate an understanding of the principles, an accelerator lever 3, a throttle lever 5, a motor lever 9, etc. are schematically illustrated in a forward-driving mode in FIG. 1.

In the First Preferred Embodiment of the present throttle control apparatus, an accelerator pedal 1 is actuated to rotate around a rotary fulcrum 1*a* when a driver depresses the pedal 1. An accelerator spring 2 urges the accelerator lever 1 in the direction of the arrow R2 of FIG. 1. When the accelerator pedal 1 is depressed, the accelerator lever 3 is actuated to move against the action of the accelerator spring 2 in the direction of the arrow R1. The direction of the arrow R1 is a valve-opening direction in which the throttle valve 4 opens to increase the inlet air amount. The direction of the arrow R2 is a valve-closing direction in which the throttle valve 4 closes to decrease the inlet air amount. The accelerator sensor 6 detects the distance by which the accelerator pedal 1 is depressed, and accordingly outputs a depression signal to a controller 7 by way of a signal cable.

The throttle valve 4 adjusts the inlet air amount, and is disposed in an inlet passage "M" of an internal combustion engine. The throttle valve 4 is disposed integrally on a throttle lever 5. A throttle sensor 8 detects the degree of opening of the throttle valve 4, and outputs an opening-degree signal to the controller 7 by way of a signal cable. The throttle lever 5 is urged by a throttle spring 18 in the direction of the arrow R2 of FIG. 1, i.e., in the valve-closing direction.

The motor lever 9 is urged by a motor spring 10 as the present urging member in the direction of the arrow R2 of FIG. 1, i.e., in the valve-closing direction. A motor 12 is provided with a motor pinion 12*c* which meshes with teeth 9*c* of the motor lever 9. The motor 12 is controlled to operate in accordance with actuating signals output by the controller 7.

A limp home lever 14 is rotatably disposed on the throttle lever 5 around a rotary fulcrum shaft 15 for rotational movement in the directions of the arrows S1 and S2 of FIG. 1. The limp home lever 14 includes an engager 16 capable of engaging the accelerator lever 3, and a pressee 17 to be pressed by a presser 9*e* of the motor lever 9. When the limp home lever 14 rotates in the direction of the arrow S2, the engager 16 arrives at an engaging position "A" where the engager 16 can mechanically engage an engagee 3*x* of the accelerator lever 3. When the limp home lever 14 rotates in the direction of the arrow S1, the engager 16 arrives at a siding position "B" where the engager 16 cannot mechanically engage the engagee 3*x* of the accelerator lever 3. A shunting spring 20 urges the limp home lever 14 in the direction of the arrow S1, i.e., in the 10 shunting direction, to contact the engager 16 with a positioning member 30. The urging force of the shunting spring 20 is adjusted to be smaller than the urging force of the motor spring 10.

A space 22 of an initial width L1 is formed between the limp home lever 14 and the motor lever 9. A space 25 of an initial width L2 is formed between the limp home lever 14 and the accelerator lever 3.

A negative pressure actuator 26 is disposed on the internal combustion engine side of the inlet passage "M". The negative pressure actuator 26 is provided with a diaphragm 27, a rod 27*c* connected with the diaphragm 27, and a stopper spring 29. The stopper spring 29 urges a stopper 28 in the direction of the arrow R1 of FIG. 1 to contact the stopper 28 with the positioning member 30. Since the throttle spring 18 urges the throttle lever 5 in the direction of the arrow R2 to contact the throttle lever 5 with the stopper 28, the degree of opening of the throttle valve 4 is set, for example, at approximately 7 degrees which is required to start the internal combustion engine when the internal combustion engine is not actuated (i.e., under the circumstances illustrated in FIG. 1). Thus, when the internal combustion engine is not actuated, the throttle lever 5 contacts the stopper 28. When the internal combustion engine is idling, negative pressure arises in the inlet passage "M" and actuates the diaphragm 27 and the rod 27*c* to retract the stopper 28 against the action of the stopper spring 29 in the direction of the arrow R2. Accordingly, the throttle lever 5 moves in the direction of the arrow R2, and the degree of opening of the throttle valve 4 is basically adjusted at about 2 degrees (i.e., standard opening degree for an idling internal combustion engine). When the internal combustion engine is idling in this manner, the motor 12 is turned on, and accordingly the stopper 28 is displaced in the direction of the arrow R2. Together with the displacement of the stopper 28, the throttle lever 5 is moved by the throttle spring 18 in the same direction. As a result, the space 22 is kept as it is, and consequently the motor lever 9 does not contact the limp home lever 14. Therefore, the limp home lever 14 is at the siding position "B". A housing of this throttle control apparatus is designated at 32.

(During Ordinary Driving)

The following description relates to how the First Preferred Embodiment of the present throttle control apparatus operates during ordinary driving or when electronic throttle control is carried out. Under the circumstance, when the accelerator pedal 1 is depressed, the controller 7 receives a signal output by the accelerator sensor 6, outputs an actuating signal in accordance with the distance of depression, and actuates the motor 12 in the valve-opening direction. Since the motor pinion 12*c* of the motor 12 meshes with the teeth of 9*c* of the motor lever 9. The motor lever 9 moves in the direction of the arrow R1 of FIG. 1 (i.e., in the valve-opening direction). Then, the throttle lever 5 moves also in the direction of the arrow R1 (i.e., in the valve-opening direction). As a result, the throttle valve 4 opens, and the degree of throttle opening increases. When the accelerator pedal 1 is depressed less than before, the controller 7 receives a signal output by the accelerator sensor 6, outputs an actuating signal in accordance with decreased distance of depression, and the motor 12 and the motor pinion 12*c* are actuated in the reverse direction. Accordingly, the motor lever 9 moves in the direction of the arrow R2. Then, the throttle lever 5 is actuated by the urging force of the throttle spring 18 in the direction of the arrow R2 (i.e., in the valve-closing direction). As a result, the degree of throttle opening decreases. In this way, during ordinary driving, the motor 12, controlled by the controller 7, controls the degree of throttle opening in accordance with depression of the accelerator pedal 1, thereby controlling the output of the internal combustion engine.

When opening the throttle valve 4 as aforementioned, the motor 12 actuates the motor lever 9 in the direction of the arrow R1 of FIG. 1, the throttle lever 5 also moves in the direction of the arrow R1, and the limp home lever 14 held on the throttle lever 5 moves in the same direction. As a result, the engager 16 of the limp home lever 14 is kept at the siding position "B". When closing the opened throttle valve 4, the motor 12 actuates the motor lever 9 in the direction of the arrow R2, the throttle lever 5 and the limp home lever 14 also move in the same direction of the arrow R1, and the space 22 is kept as it is. As a result, the motor lever 9 does not press the limp home lever 14, and the engager 16 of the limp home lever 14 is kept at the siding position "B". Thus, during ordinary driving, the engager 16 is kept at the siding position "B". Accordingly, the motor lever 9 and the limp home lever 14 are inhibited from engaging each other. Therefore, even if depression of the accelerator pedal 1 actuates the accelerator lever 3, the engager 16 of the limp home lever 14 does not engage the accelerator lever 3. Thus, it is possible to carry out electronic throttle control independently of the operation of the accelerator pedal 1.

(If Failures Occur)

On the other hand, when failures in the electric system occur, the motor 12 is turned off. When the motor 12 is turned off, the force of the motor 12 for holding the motor lever 9 is canceled, and the motor lever 9 is pulled by the urging force of the motor spring 10 in the direction of the arrow R2 of FIG. 1 (i.e., in the valve-closing direction). Accordingly, the throttle spring 18 actuates the throttle lever 5 in the direction of the arrow R2 (i.e., in the valve-closing direction), and the throttle lever 5 contacts the stopper 28. Under this situation, the throttle lever 5 is regulated at the position where it contacts the stopper 28, but the motor lever 9 is pulled and actuated by the urging force of the motor spring 10 in the direction of the arrow R2. As a result, the motor lever 9 moves in the direction of the arrow R2 beyond the position designated at E1, and the space 22 disappears. Consequently, the presser 9*e* of the motor lever 9 presses the pressee 17 of the limp home lever 14, and thereby the limp home lever 14 rotates in the direction of the arrow S2. Thus, the engager 16 of the limp home lever 14 moves toward the accelerator lever 3 and arrives at the engagement position "A". At the engagement position "A", the engager 16 of the limp home lever 14 and the engagee 3*x* of the accelerator lever 3 are placed in a mechanically engageable state.

As aforementioned, when the motor 12 is turned off due to a failure in the electric system, one might desire to drive the vehicle to a repair shop in emergency. If such is the case, when a driver depresses the accelerator pedal 1, the accelerator lever 3 moves in the direction of the arrow R1 of FIG. 1 against the action of the accelerator spring 2, and the engagee 3*x* of the accelerator lever 3 and the engager 16 of the limp home lever 14 engage each other mechanically. Accordingly, the throttle lever 5 can be actuated in the direction of the arrow R1 (i.e., the valve-opening direction), and the degree of opening of the throttle valve can be increased. When the extent to which the driver depresses the accelerator pedal 1 is reduced, the accelerator spring 2 actuates the accelerator lever 3 in the direction of the arrow S2, and so the mechanical engagement between the engagee 3*x* of the accelerator lever 3 and the engager 16 of the limp home lever 14 is canceled. As a result, the throttle spring 18 actuates the throttle lever 5 in the direction of the arrow R2 (i.e., in the valve-closing direction), and the degree of throttle opening can be decreased. Thus, when the motor 12 is turned off, the output of internal combustion engine can be adjusted by increasing or decreasing the degree of opening of the throttle. Hence, it is possible to drive a vehicle in an emergency.

Figure 5:
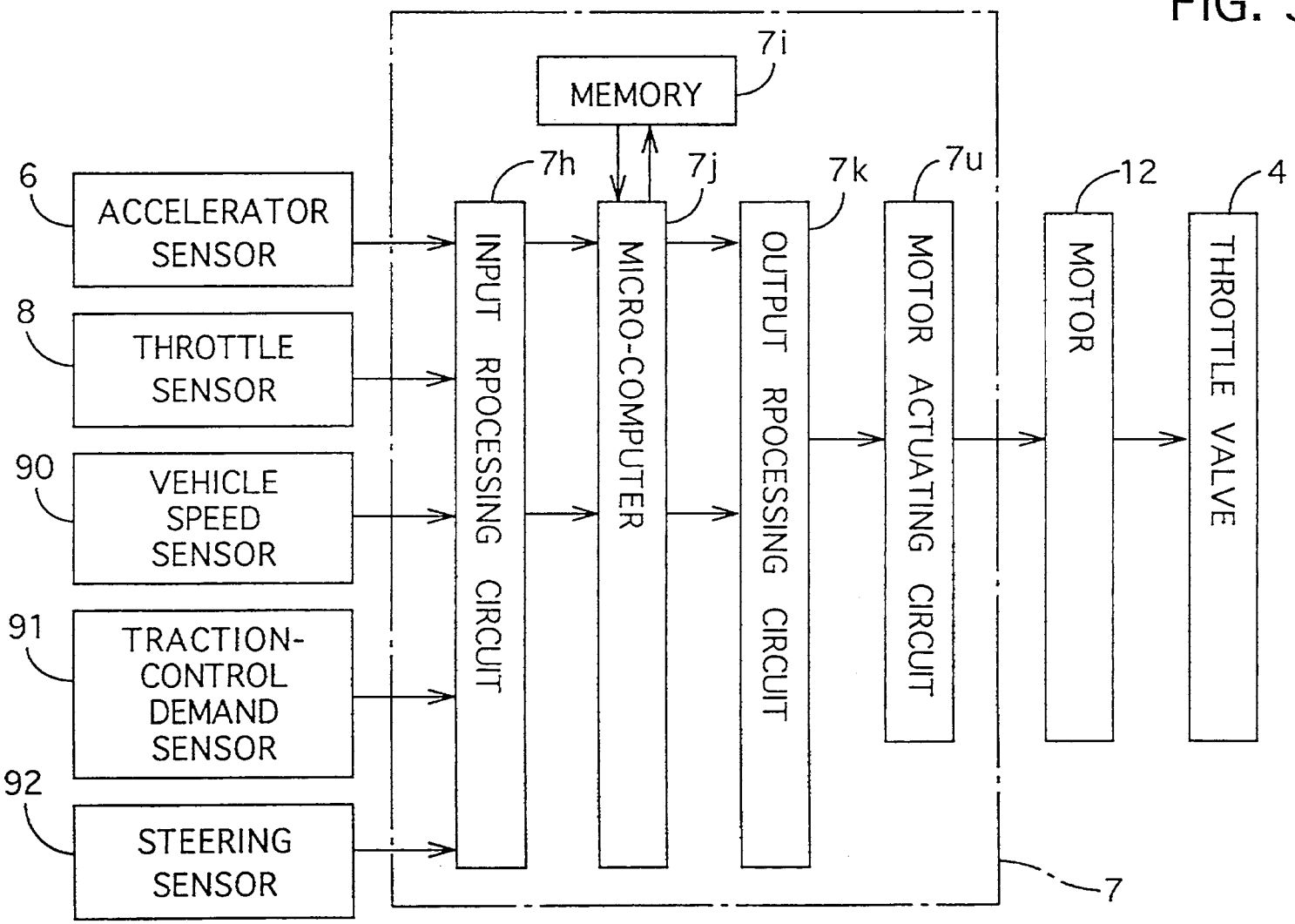
FIG. 5 is a block diagram for illustrating a controller employed by the First and Second Preferred Embodiments thereof.

The controller 7 is a control apparatus comprising a microcomputer, and, as illustrated in FIG. 5, is composed of an input processing circuit 7*h*, a microcomputer 7*j*, an output processing circuit 7*k*, a memory 7*i* and a motor actuating circuit 7*u*. The aforementioned signals output by the accelerator sensor 6 and the throttle sensor 8 are input to the controller 7. For instance, the controller 7 compares a target throttle opening degree dependent on the distance of depression of the accelerator pedal 1 with the actual throttle opening degree, and detects a difference therebetween. When it detects a deference, the controller 7 controls the actuation of the motor 12 to cancel the difference. Further, signals output by a vehicle speed sensor 90, a traction-control demand sensor 91 and a steering sensor 92 are input to the controller 7. The traction-control demand sensor 91 detects slip in accordance with a difference between revolutions of the driving wheels and the driven wheels, and outputs a signal demanding TRC control. The steering sensor 92 detects, for example, whether or not a steering wheel is operated when TRC control is carried out, and determines target slippage in accordance with the detection.

In the First Preferred Embodiment of the present throttle control apparatus illustrated in FIG. 1, the throttle spring 18 includes a pair of springs disposed parallel to one another so that the throttle valve 4 can be securely actuated in the valve-closing direction. The motor spring 10 also includes a pair of springs disposed parallel to one another. They can also include three or more parallel springs. When they are constructed in the aforementioned manner, and when one of the springs, constituting, for example, the motor spring 10, breaks, the other spring can reliably actuate the limp home lever 14. Thus, it is advantageous to employ this construction for driving in an emergency. This description is identically applicable to the throttle spring 18.

Moreover, in the First Preferred Embodiment of the present throttle control apparatus, the urging force of the stopper spring 29 is set to be larger than the sum of the urging force of the throttle spring 18 and the motor spring 10. As a result, this arrangement can securely give stopper function to the stopper 28, and is advantageous for fixing the degree of opening of the throttle.

Second Preferred Embodiment, Modified Version of First Preferred Embodiment

Figure 2:
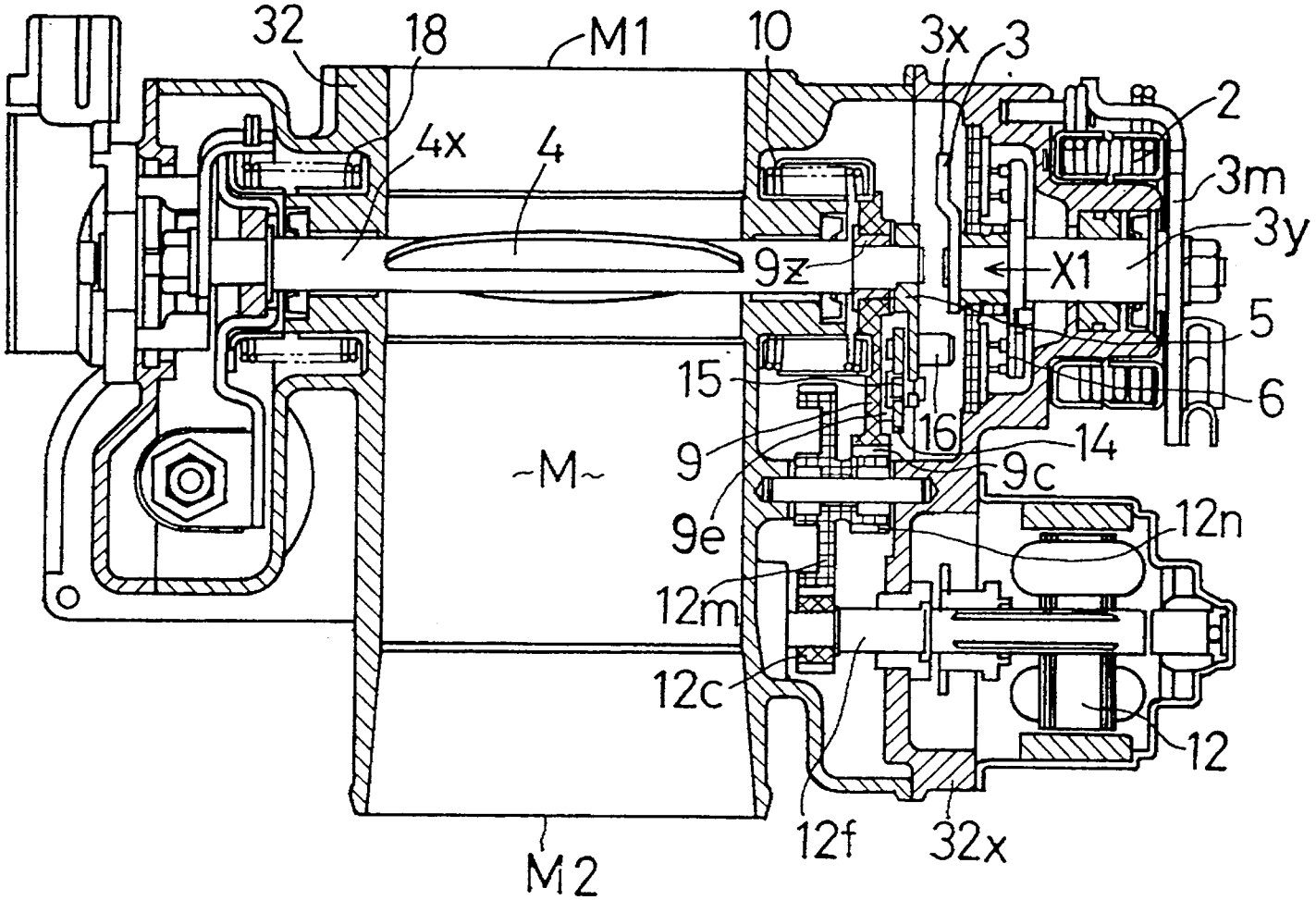
FIG. 2 is a cross-sectional view of a Second Preferred Embodiment of a throttle control apparatus according to the present invention.
Figure 3:
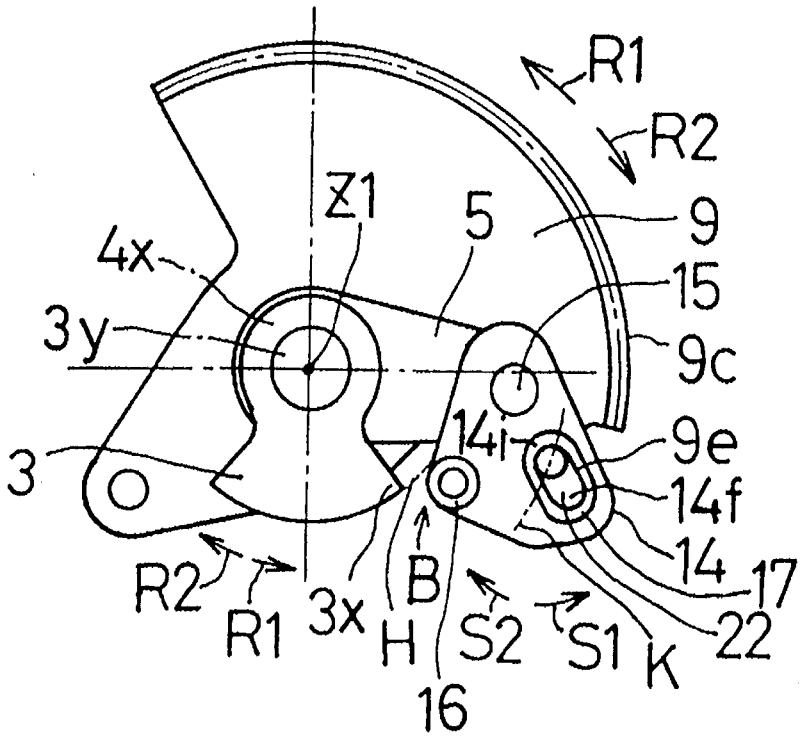
FIG. 3 is a constitutional diagram for illustrating how major portions of the Second Preferred Embodiment thereof operate.
Figure 4:
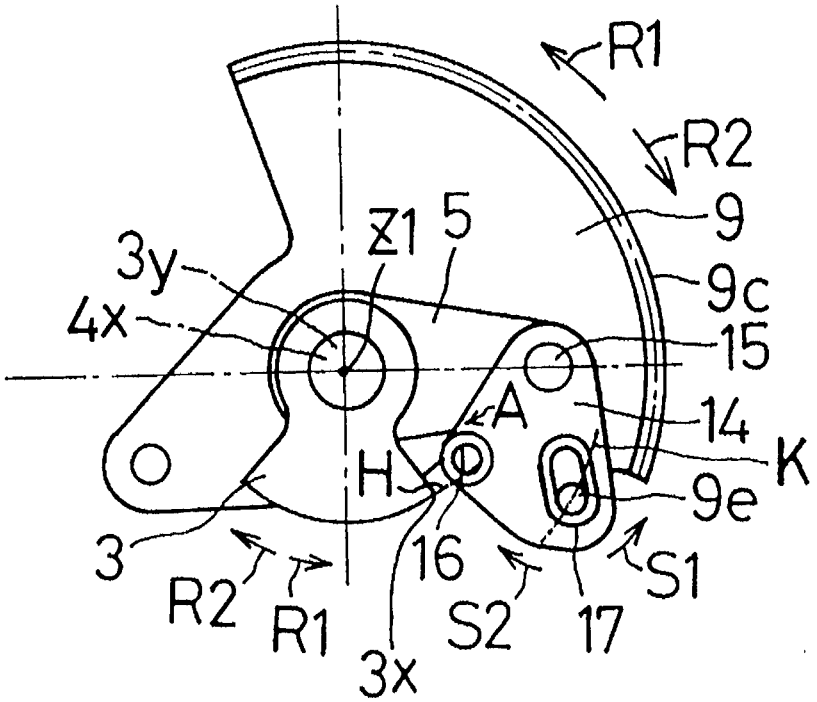
FIG. 4 is a constitutional diagram for illustrating how major portions of the Second Preferred Embodiment thereof operate.

FIGS. 2 through 4 illustrate a modified version (i.e., Second Preferred Embodiment) of the First Preferred Embodiment to which the above-described principles of the present invention are applied. FIG. 2 illustrates a general cross-sectional view of the Second Preferred Embodiment of the present throttle control apparatus according to the present invention. FIG. 3 illustrates major portions of the Second Preferred Embodiment viewed in the direction of the arrow X1 of FIG. 2. Likewise, FIG. 4 illustrates major portions of the Second Preferred Embodiment viewed in the direction of the arrow X1 of FIG. 2. In FIGS. 2 through 4 illustrating the Second Preferred Embodiment, component parts functioning identically and their operating directions are designated with the same numbers and arrows as those of FIG. 1 illustrating the principles of the present invention.

As illustrated in FIG. 2, the housing 32 includes the inlet passage "M". An internal combustion engine (not shown) is disposed on an end M1 of the inlet passage "M" and an air cleaner (not shown) is disposed on the other end M2 of the passage. The housing 32 is covered with a cover 32*x*. An accelerator shaft 3*y* is rotatably disposed in the cover 32*x*. At an end of the accelerator shaft 3*y*. A fixture bracket 3*m* is held for fixing the cable extending from the accelerator pedal 1. At the other end of the accelerator shaft 3*y*, there is fixed the accelerator lever 3.

As best shown in FIG. 3, the accelerator lever 3 includes the engagee 3*x*, and is urged by the accelerator spring 2 (shown in FIG. 2) in the direction of the arrow R2 of FIG. 3. When a driver depresses the accelerator pedal 1, the accelerator lever 3 is actuated around the accelerator shaft 3*y* along the locus "H" in the direction of the arrow R1 in accordance with the amount of depression of the accelerator pedal 1 which is conveyed by way of the accelerator shaft 3*y*. Adjacent to the accelerator shaft 3*y*, as illustrated in FIG. 2, there is disposed the accelerator sensor 6 for detecting depression of the accelerator pedal 1.

As illustrated in FIG. 2, there is rotatably disposed in the housing 32 a throttle shaft 4*x*, provided with the throttle valve 4. The throttle valve 4 is disposed in the inlet passage "M" of the housing 32. When the throttle valve 4 rotates, the throttle opening degree is adjusted, thereby adjusting the inlet air amount to the internal combustion engine. The throttle shaft 4*x* and the throttle valve 4 are urged by the throttle spring 18 in the direction of the arrow R2 of FIG. 3 (i.e., the valve-closing direction).

As best shown in FIG. 2, the throttle lever 5 is fixed at one end of the throttle shaft 4*x*. Also, at the one end of the throttle shaft 4*x* and adjacent to the throttle lever 5, there is held the motor lever 9 by way of a bearing 9*z*. As illustrated in FIG. 3, the motor lever 9 is formed as a sector shape, and is capable of rotating in the direction of the arrow R1 (i.e,, in the valve-opening direction) as well as in the direction of the arrow R2 (i.e., in the valve-closing direction). Note that, however, the throttle shaft 4*x* does not rotate directly when the motor lever 9 rotates. The motor lever 9 is urged by the motor spring 10 (shown in FIG. 2) in the direction of the arrow R2 (i.e., in the valve-closing direction). On the motor lever 9 there is fixed the pin shape presser 9*e* which operates as the present position regulator. Since the presser 9*e* is made integrally with the motor lever 9, it rotates around a shaft center Z1 along the locus "K".

As illustrated in FIG. 3, the limp home lever 14 of polygonal shape is rotatably disposed on the throttle lever 5 around the rotary fulcrum shaft 15. Thus, the limp home lever 14 can rotate around the rotary fulcrum shaft 15 in the directions of the arrows S1 and S2 of FIG. 3. The limp home lever 14 is provided with the pin shape engager 16 and a slot 14*f* capable of operating as the present regulatee. Into the slot 14*f*, there is fitted the presser 9*e* of the motor lever 9 to produce the space 22 (See FIG. 3). When the limp home lever 14 rotates in the direction of the arrow S1, the pin-shaped engager 16 of the limp home lever 14 arrives at the siding position "B" of FIG. 3. In the First Preferred Embodiment described with reference to FIG. 1 (i.e., the principle diagram), there is disposed the shunting spring 20 for urging the limp home lever 14 to the siding position "B". However, in this Second Preferred Embodiment, there is not disposed any shunting spring. When the First Preferred Embodiment is not provided with the shunting spring 20, the limp home lever 14 is positioned invariably so that it might rotate to the engagement position "A". On the other hand, in the Second Preferred Embodiment, the presser 9*e* of the motor lever 9 is fitted into the slot 14*f* of the limp home lever 14 to regulate operation of the limp home lever 14. Consequently, even when the shunting spring 20 is removed, the limp home lever 14 is not positioned invariably.

As illustrated in FIG. 2, in the Second Preferred Embodiment, the motor 12 is held in the cover 32*x* of the housing 32. In the motor 12, a motor shaft 12*f* includes the motor pinion 12*c* fixed thereto. Further, the motor pinion 12*c* meshes with a major gear 12*m*, a minor gear 12*n* is formed integrally with the major gear 12*m*, and the minor gear 12*n* meshes with the teeth 9*c* of the motor lever 9. Thus, the teeth 9*c* of the motor lever 9 and the minor gear 12*n* constitute a speed reducer mechanism.

(During Ordinary Driving)

The Second Preferred Embodiment thus constructed operates similarly to the First Preferred Embodiment illustrated in FIG. 1, the principle diagram. When the accelerator pedal 1 is depressed, the controller 7 receives a signal output by the accelerator sensor 6, and actuates the motor 12 in the valve-opening direction in accordance with the amount of depression. When the motor pinion 12*c* of the motor 12 rotates, the major gear 12*m* rotates, the minor gear 12*n* rotates, and the motor lever 9 rotates in the direction R1 of FIG. 4 (i.e., in the valve-opening direction). Accordingly, the throttle control apparatus changes its state from the state illustrated in FIG. 4 to the state illustrated in FIG. 3. That is, the presser 9*e* of the motor lever 9 rotates in the same direction around the shaft center Z1 along the locus "K". As the presser 9*e* rotates in this manner, the presser 9*e* moves along the slot 14*f* upward in the drawing, the slot 14*f* changes its disposing direction, and the limp home lever 14 rotates around the rotary fulcrum shaft 15 in the direction of the arrow S1. As a result, the engager 16 arrives at the siding position "B" illustrated in FIG. 3. When the presser 9*e* presses an end 14*i* of the slot 14*f*, the actuating force of the motor lever 9 is conveyed to the throttle lever 5 by way of the limp home lever 14, and the throttle lever 5 rotates in the direction of the arrow R1 to open the throttle valve 4. Note that, before the presser 9*e* presses the end 14*i*, the throttle lever 5 does not rotate even when the motor lever 9 rotates.

When the engager 16 arrives at the siding position "B", the engagee 3*x* of the accelerator lever 3 and the engager 16 of the limp home lever 14 do not engage each other even if the accelerator lever 3 is rotated by depressing the accelerator lever 1 in the direction of the arrow R1 of FIG. 3.

On the other hand, when the extent to which the accelerator pedal 1 is depressed is reduced, the controller 7 receives a signal output by the accelerator sensor 6, and outputs an actuating signal to the motor 12 in accordance with the amount of depression. The motor lever 9 rotates in the direction of the arrow R2 of FIG. 3, and the throttle spring 18 actuates the throttle lever 5 in the direction of the arrow R2 (i.e., the valve-closing direction). Thus, the throttle opening degree decreases. During these operations, the presser 9*e* disposed integrally with the motor lever 9 moves along the slot 14*f* in the direction of the arrow R2, and the limp home lever 14 displaces around the rotary fulcrum shaft 15 in the direction of the arrow S2. However, since the accelerator pedal 1 is depressed less, the accelerator lever 3 also retracts in the direction of the arrow R2. Eventually, the engagee 3*x* of the accelerator lever 3 and the engager 16 of the limp home lever 14 do not engage each other. As a result, also in the Second Preferred Embodiment, the motor lever 9 and the limp home lever 14 can be inhibited from contacting each other during ordinary driving or when electronic throttle control is carried out.

(If Failures Occur)

Moreover, like the First Preferred Embodiment illustrated in FIG. 1 (i.e., the principle diagram), when the motor 12 is turned off due to failures in the electric system, the urging force of the motor spring 10 actuates the motor lever 9 in the direction of the arrow R2 (i.e., in the valve-closing direction). Simultaneously therewith, the throttle lever 5 also rotates in the direction of the arrow R2 (i.e., in the valve-closing direction). Accordingly, the throttle valve 4 is fully closed or substantially fully closed. Further, like the First Preferred Embodiment illustrated in FIG. 1, although the stopper 28 (not shown in FIGS. 2 through 4) restricts the throttle lever 5 to rotate in the direction of the arrow R2, the urging force of the motor spring 10 pulls and rotates the motor lever 9 in the direction of the arrow R2. Accordingly, the presser 9*e* of the motor lever 9 moves along the slot 14*f*, and presses the pressee 17 of the limp home lever 14. Hence, as can be seen from FIG. 4, the limp home lever 14 rotates around the rotary fulcrum shaft 15 in the direction of the arrow S2, and the engager 16 of the limp home lever 14 moves toward the accelerator lever 3 and arrives at the engagement position "A". At the engagement position "A", the engager 16 of the limp home lever 14 and the engagee 3*x* of the accelerator lever 3 are put into a mechanically engageable state.

Under the above-described circumstance, when a driver depresses the accelerator pedal 1 in order to drive a vehicle in an emergency, the accelerator lever 3 rotates in the direction of the arrow R1 of FIG. 4, and the engager 3*x* of the accelerator lever 3 rotates along the locus "H". Thus, the engagee 3*x* of the accelerator lever 3 mechanically engages the engager 16 of the limp home lever 14. When the accelerator lever 3 rotates further in the direction of the arrow R1, the engagee 3*x* presses the engager 16, and the throttle lever 5 rotates in the direction of the arrow R1 (i.e., in the valve-opening direction). Consequently, the throttle-valve-opening degree can be increased.

When the motor 12 is turned off and when the extent to which the accelerator pedal 1 is depressed is reduced, the accelerator spring 2 actuates the accelerator lever 3 to rotate in the direction of the arrow R2 of FIG. 4. As a result, like the First Preferred Embodiment illustrated in FIG. 1 (i.e., the principle diagram), the throttle spring 18 actuates the throttle lever 5 in the direction of the arrow R2 (i.e., the valve-closing direction). Consequently, the throttle-valve-opening degree can be decreased.

Thus, in accordance with the Second Preferred Embodiment, the throttle-valve-opening degree can be increased and decreased not only when electronic throttle control is carried out but also when electric power supply is shut off to the motor 12, so that the output of internal combustion engine can be adjusted. Hence, it is possible to drive a vehicle in emergency.

In the Second Preferred Embodiment, as can be appreciated from FIG. 3, the motor lever 9 is disposed coaxially with the throttle shaft 4*x*. This arrangement can advantageously downsize the throttle control apparatus, especially in the axial direction. Moreover, in the Second Preferred Embodiment, the above-described speed reducer mechanism is integrated with the motor lever 9. This latter arrangement as well can downsize the throttle control apparatus.

Third Preferred Embodiment

In the First and Second Preferred Embodiments described above, when carrying out electronic throttle control with the motor 12 controlled by the controller 7, the limp home lever 14 is actively shunted to the siding position "B". This shunting operation can contribute to solving the problem resulting from the mechanically engaged limp home 14 during TRC control.

However, under the following rare occasions, there might arise a fear that the limp home lever 14 and the accelerator lever 3 will engage each other. A first one of the rare occasions occurs when a motor of low responsibility is employed. A second one of the rare occasions occurs when the throttle valve 4 is further closed from the standard opening degree for an idling internal combustion engine (e.g., about 2 degrees). For instance, when engine speed increases suddenly during idling, the throttle valve 4 is sometimes controlled to close by an opening degree of 2 degrees or less. Under these circumstances, when the accelerator pedal 1 is abruptly depressed, engagement between the limp home lever 14 and the accelerator lever 3 can occur on rare occasions.

Figure 6:
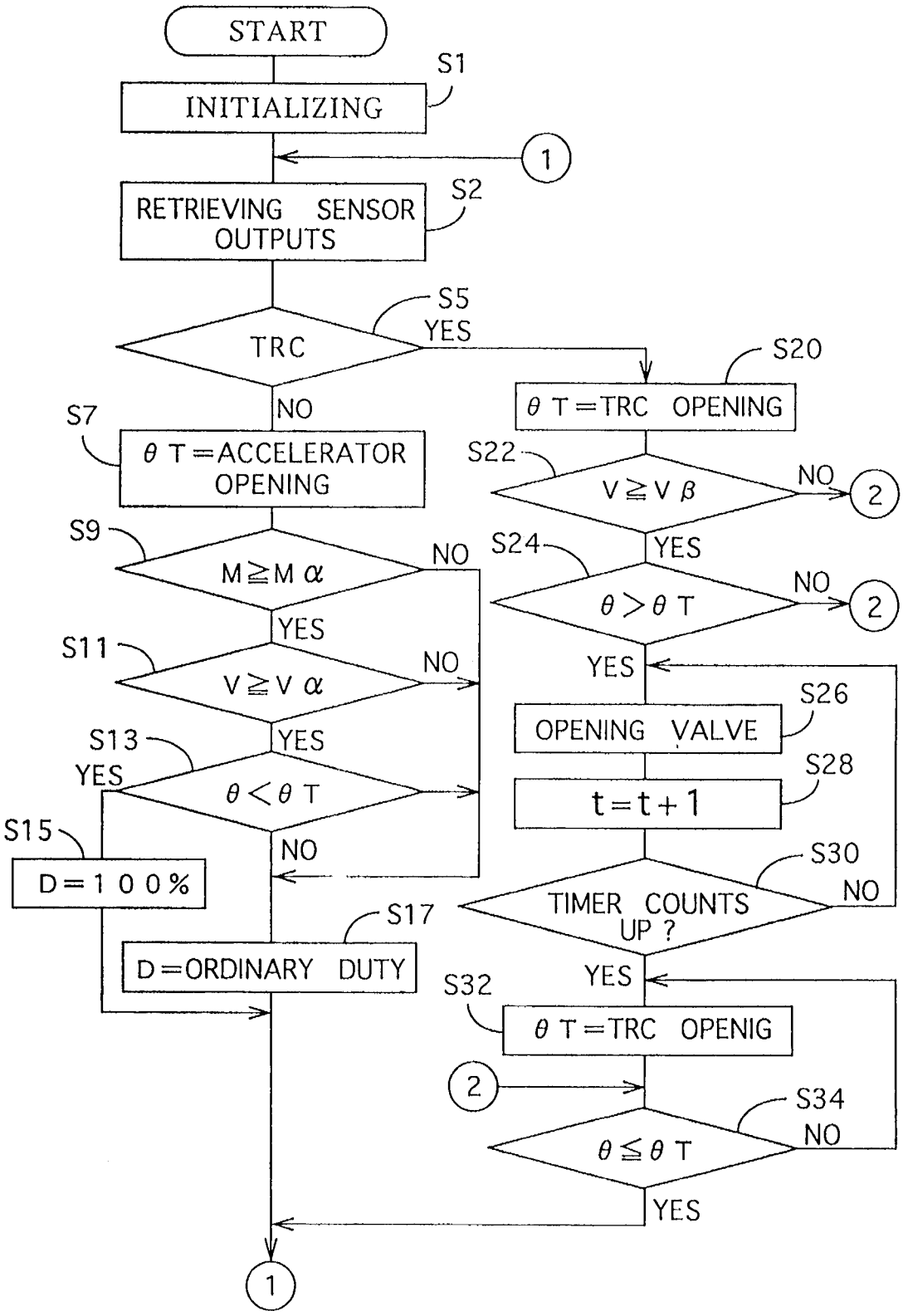
FIG. 6 is a flow chart which is carried by a CPU of a controller employed by a Third Preferred Embodiment of a throttle control apparatus according to the present invention.

Taking these rare occasions into consideration, in the Third Preferred Embodiment of the present throttle control apparatus, the following control is carried out. FIG. 6 illustrates a flow chart on control routines which are carried out by a CPU incorporated in the microcomputer of the controller 7 employed by the Third Preferred Embodiment. The flow chart will be hereinafter described together with the circumstances behind the control routines. When a power source is turned on, the control starts by first initializing the controller 7 at Step S1. At step S3, the controller 7 reads signals output by sensors. At step S5, it judges whether TRC control is demanded. If not, it proceeds to step S7, and sets the accelerator opening degree detected by the accelerator sensor 6 as a target throttle opening degree θT.

When the accelerator pedal 1 is depressed, as earlier described, the motor lever 9 is actuated in the direction of the arrow R1 of FIG. 1 in accordance with the amount of depression detected by the accelerator sensor 6, and the throttle lever 5 is actuated in the direction of the arrow R1, thereby increasing throttle-valve-opening degree. Depending on the amount of depression of the accelerator pedal 1, the engagee 3*x* of the accelerator lever 3 are actuated in the direction of the arrow R1. However, the throttle lever 5 and the limp home lever 14 are actuated by the action of the motor 12 and the motor lever 9 in the direction of the arrow R1 to open the throttle valve 4, and the space 22 is kept as it is. Accordingly, as aforementioned, the engager 16 and the engagee 3*x* are not mechanically engaged with each other. However, when the accelerator pedal 1 is depressed abruptly and when a motor of low responsibility is employed, although the engagee 3*x* of the accelerator lever 3 is actuated abruptly in the direction of the arrow R1, the throttle lever 5 and the limp home lever 14 are retarded to move in the direction of the arrow R1, As a results there might arise, in rare occasions, a fear for the engagement between the limp home lever 14 and the accelerator lever 3. In order to avoid retarded response of the motor 12, it is possible to employ a motor having a large rating. A motor of large rating is, however, disadvantageous for downsizing the throttle control apparatus and reducing manufacturing cost.

Therefore, in the Third Preferred Embodiment, the controller 7 judges at step S9, as illustrated in FIG. 6, whether the distance of depression M of the accelerator pedal 1 is a predetermined value Mα or more. When the depression distance M is the predetermined value Mα or more, it judges at step S11 whether the depression speed V of the accelerator pedal 1 is a predetermined value Vα or more. When the depression speed V is the predetermined value Vα or more, it recognizes that the accelerator pedal 1 is depressed abruptly. Then, at step S13, it judges whether the current throttle opening degree θ is less than a target throttle opening degree θT. When the current throttle opening degree θ is the target throttle opening degree θT or more, the motor 12 is normal in terms of responsibility. Accordingly, the controller 7 gives the motor 12 normal duty ratio D at step S17, and returns to step S3.

On the other hand, when the controller 7 judges at step S13 that the current throttle opening degree θ is less than θT, the target throttle opening degree is not established so as to meet depression distance of the accelerator pedal 1. Thus, the controller 7 recognizes that responsibility of the motor 12 is low. Accordingly, it outputs a command at step S15 so as to give the motor 12 increased duty ratio D, and returns to step S3. Hence, step S15 functions as the present motor-output increasing means.

When the throttle opening degree should be decreased to less than the standard opening degree for idling (e.g., about 2 degrees), it is necessary to contract the stopper spring 29 of large urging force to displace the stopper 28 in the direction of the arrow R2 of FIG. 1. Hence, it is necessary to actuate the motor 12 to move the motor lever 9 in the direction of the arrow R2, to remove the space 22, to press the limp home lever 14 with the motor lever 9, to actuate the throttle lever 5 further in the direction of the arrow R2 than it is illustrated in FIG. 1, and to press the stopper spring 29 with the throttle lever 5. If such is the case, the motor lever 9 presses the limp home lever 14, and accordingly the limp home lever 14 shifts in the direction of the arrow R2 to the engagement position "A". Under the circumstance, when the accelerator lever 1 is depressed abruptly, there might arise a fear that the accelerator lever 3 is actuated in the direction of the arrow R1 to contact the engager 16 of the limp home lever 14, and that the limp home lever 14 engages with the accelerator lever 3. This engagement can be canceled when the accelerator lever 3 moves in the direction of the arrow R2, because the shunting spring 20 urges the limp home lever 14 to rotate in the direction of the arrow S1. However, when TRC control is carried out, the engagement cannot be canceled, though the accelerator lever 3 moves in the direction of the arrow R1, because the throttle lever 5 moves in the direction of the arrow R2.

Hence, in the Third Preferred Embodiment, the CPU of the controller 7 is requested to carry out TRC control in accordance with a signal output by the traction-demand sensor 91. Then, as illustrated in FIG. 6, the controller 7 judges at step S5 whether TRC control is demanded. When the controller 7 recognizes at step S5 that TRC control is demanded, it sets, at step S20, a target throttle opening degree θT to TRC opening degree. Further, it judges at step S22 whether the depression speed V of the accelerator pedal 1 is a predetermined value Vβ or more. When the depression speed V is the predetermined value Vβ or more, it proceeds to step S24, and judges whether the throttle opening degree θ detected by the throttle sensor 8 is more than θT (i.e., target throttle opening degree during TRC control). When the throttle opening degree θ is more than a target throttle opening degree θT, the controller 7 recognizes that the actual throttle opening degree is not decreased and that the aforementioned engagement occurs. Consequently, in order to cancel the engagement, the controller 7 actuates the motor 12 in the valve-opening direction for a predetermined period of time at steps S26 through S30. As a result, the motor lever 9 is temporarily retracted in the direction of the arrow R1 (i.e., in the valve-opening direction), and the limp home lever 14 is actuated by the urging force of the shunting spring 20 in the direction of the arrow S1 and immediately positioned at the siding position "B". Thus, the engagement can be canceled. Thereafter, at step S32, the controller 7 sets a target throttle opening degree to TRC opening degree, and actuates the motor 12 in the valve-closing direction. Finally, at step S34, it judges whether throttle opening degree θ is θT (i.e., target throttle opening degree during TRC control) or less. When it judges to this effect, it recognizes that the engagement has been canceled, and returns to step S3.

Fourth Preferred Embodiment

Figure 7:
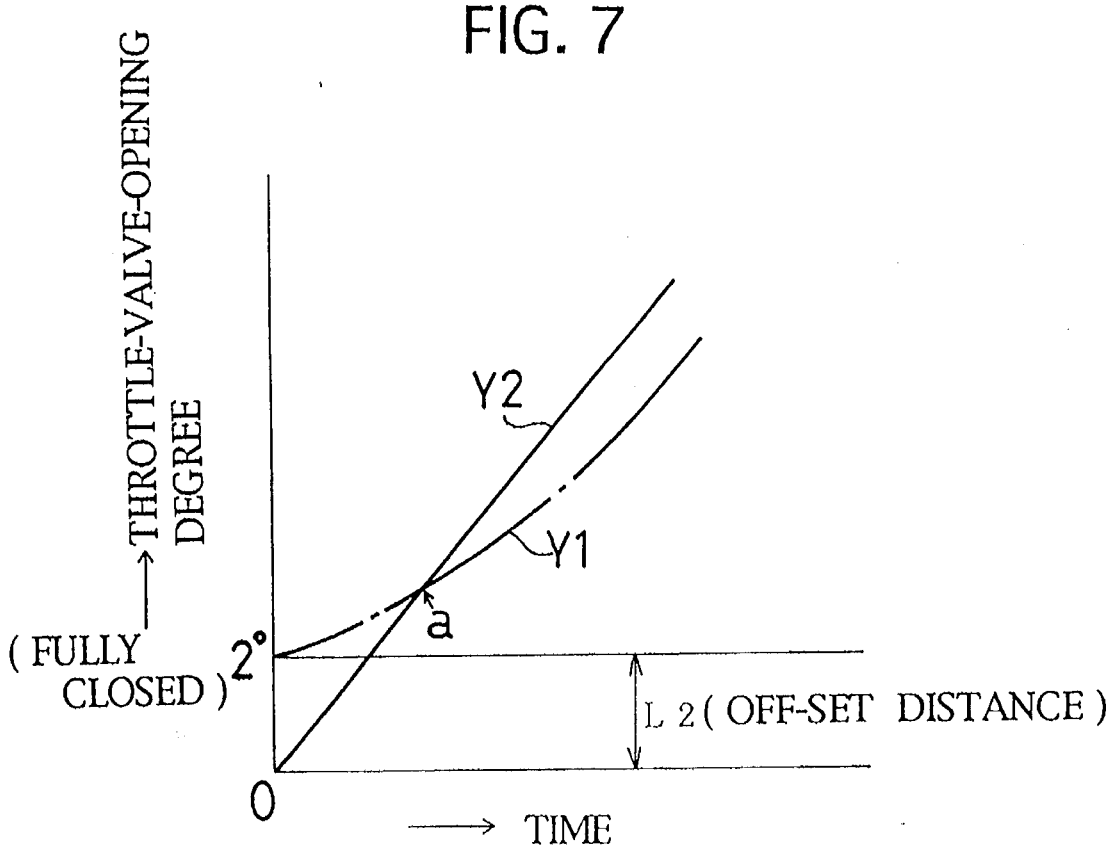
FIG. 7 is a graph for schematically illustrating a valve-opening characteristic curve of a throttle valve controlled by a motor and a valve-opening characteristic curve of a throttle valve controlled by an accelerator lever which are exhibited by a Fourth Preferred Embodiment of a throttle control apparatus according to the present invention.
Figure 8:
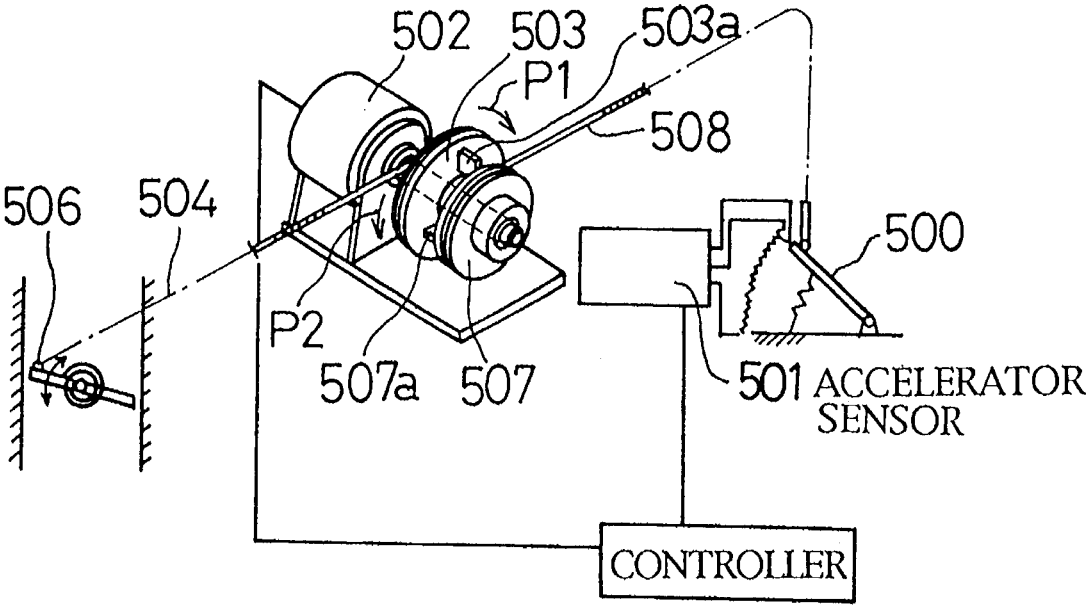
FIG. 8 is a constitutional diagram for illustrating major portions of the conventional throttle control apparatus disclosed in Japanese Unexamined Patent Publication (KOKAI) No. 59-122,742.

As described above, when a motor of unsatisfactory responsibility is employed, or when the throttle valve 4 is closed by more than the standard opening degree for idling (e.g., about 2 degrees), there might arise a fear for the engagement between the accelerator lever 3 and the limp home lever 14. However, even if the engagement occurs, it is possible to actuate the throttle lever 5 in the valve-opening direction so as to open the throttle valve 4 by utilizing the engagement. For instance, in FIG. 7, the characteristic curve Y1 specifies operational characteristic of the throttle valve 4 whose valve opening degree is increased by the motor 12. As illustrated by the characteristic curve Y1, the valve opening degree is increased gradually while showing retardation in responsibility. The characteristic curve Y2 specifies the operational characteristic of the throttle valve 4 whose valve opening degree is increased by the accelerator lever 3. As can be appreciated from FIG. 1, the off-set distance L2 of FIG. 7 means the distance between the engagee 3*x* of the accelerator lever 3 and the engager 16 of the limp home lever 14. In other words, the off-set distance L2 means the space 25 of FIG. 1. When there exists the off-set distance L2, the aforementioned engagement does not occur. When the off-set distance L2 disappears, the engagement occurs.

Therefore, when the off-set distance L2 is adjusted properly, even if the motor 12 is of insufficient responsibility the throttle valve 4 can be opened by the motor 12 in the initial operational range, and, subsequent to the initial operational ranges the throttle valve 4 can be opened by the actuating force of the accelerator lever 3 which utilizes the mechanical engagement between the accelerator lever 3 and the limp home lever 14. That is, for the purpose of opening the throttle valve 4, the mechanical engagement can compensate the valve-opening characteristic of the throttle valve 4 actuated by the motor 12. Hence, in FIG. 7, starting from the point "a", throttle opening degree of the throttle valve 4 can be increased in accordance with the characteristic curve Y2, and accordingly throttle opening speed thereof can be increased. Thus, the throttle valve 4 is enhanced in terms of valve-opening responsibility. Note that, in the Fourth Preferred Embodiment as well, the engagement can be canceled by releasing the accelerator pedal 1.

Having now fully described the present invention, it will be apparent to one of ordinary skill in the art that many changes and modifications can be made thereto without departing from the spirit or scope of the present invention as set forth herein including the appended claims.

What is claimed is:

1. A throttle control apparatus for carrying out electronic throttle control, wherein a throttle valve is opened and closed by a motor actuated in accordance with depression of an accelerator pedal, the apparatus comprising:

an accelerator lever actuated in accordance with depression of said accelerator pedal;

a throttle lever provided with said throttle valve;

a motor lever actuated by said motor to operate said throttle lever in a valve-opening direction and in a valve-closing direction;

a limp home lever including a first engager for engaging said accelerator lever and a second engager for engaging said motor lever, said limp home lever being held rotatably on said throttle lever to rotate to an engagement position where the first engager can mechanically engage said accelerator lever and to a siding position where the engager cannot mechanically engage said accelerator lever;

shunting means provided between said throttle lever and said home lever, said shunting means actuating said limp home lever from the engagement position to the siding position; and a spring provided with said motor lever, and actuating said motor lever to engage said second engager of said limp home lever to rotate said limp home lever towards said engagement position.

2. A throttle control apparatus for carrying out electronic throttle control, wherein a throttle valve is opened and closed by a motor actuated in accordance with depression of an accelerator pedal, the apparatus comprising:

an accelerator lever actuated in accordance with depression of said accelerator pedal;

a throttle lever provided with said throttle valve;

a motor lever actuated by said motor to operate said throttle lever in a valve-opening direction and in a valve-closing direction;

a limp home lever including an engager capable of engaging said accelerator lever, said limp home lever being held rotatably on said throttle lever to rotate to an engagement position where the engager can mechanically engage said accelerator lever and to a siding position where the engager cannot mechanically engage said accelerator lever; and urging means for urging said motor lever and said throttle lever in the valve-closing direction, the urging means actuating said limp home lever to rotate to the siding position when electronic throttle control is carried out by said motor, and actuating said limp home lever to rotate to the engagement position to mechanically engage the engager of said limp home lever with the accelerator lever when electronic throttle control is not carried out by said motor, thereby interlocking operation of said throttle lever with operation of said accelerator pedal.

3. The throttle control apparatus according to claim 2, wherein said urging means includes a first urging means for urging said motor lever in the valve-closing direction, and a second urging means for urging said throttle lever in the valve-closing direction.

4. The throttle control apparatus according to claim 3, wherein at least one of said first urging means and said second urging means includes a plurality of springs which are disposed parallel to each other.

5. The throttle control apparatus according to claim 2, further comprising auxiliary urging means for urging said limp home lever to the sliding position, the auxiliary urging means having art urging force smaller than an urging force of the urging means.

6. The throttle control apparatus according to claim 2, further comprising stopper means for stopping said throttle lever from operating in the valve-opening direction, the stopper means including a displaceable diaphragm that is displaced in accordance with negative pressure produced in an inlet passage of art internal combustion engine provided with said throttle valve, a stopper connected with the diaphragm, a positioning member for positioning the stopper, a stopper spring for urging the stopper to the positioning member, the stopper spring contacting the stopper with the positioning member and having art urging force larger than that of the urging means.

7. The throttle control apparatus according to claim 2 wherein, said motor and said motor lever are connected by way of speed reducer means.

8. The throttle control apparatus according to claim 2, wherein said throttle lever and said motor lever are disposed coaxially.

9. The throttle control apparatus according to claim 2, wherein said throttle lever, said motor lever and said accelerator lever are disposed coaxially, said throttle lever has a leading end and a trailing end, and said limp home lever is swingably disposed on a rotary fulcrum shaft at a leading end of said throttle lever.

10. The throttle control apparatus according to claim 2, wherein said limp home lever includes a regulatee formed of one member selected from the group consisting of concavity and convexity, and said motor lever includes a position regulator formed of another one member selected from the group consisting of concavity and convexity, thereby positionally regulating said limp home lever by holding the regulatee with the position regulator.

11. The throttle control apparatus according to claim 10, wherein said regulatee of said limp home lever is constituted by a slot, and said position regulator of said motor lever is constituted by a pin fixed on said motor lever and fitted into the slot.

12. The throttle control apparatus according to claim 2, further comprising a controller for controlling said motor, the controller including an accelerator sensor capable of detecting depression of said accelerator pedal and a throttle sensor capable of detecting a degree of opening of said throttle valve.

13. The throttle control apparatus according to claim 2 further comprising:

traction-control demand detecting means for detecting demand of traction control; and motor temporarily-controlling means for temporarily actuating said motor in the valve-opening direction and thereafter actuating said motor in the valve-closing direction when traction control is demanded, when said accelerator pedal is abruptly depressed and when said limp home lever engages with said accelerator lever.

14. The throttle control apparatus according to claim 13, wherein said motor temporarily-controlling means temporarily actuates said motor in the valve-opening direction when said accelerator pedal is depressed by a target depression speed or more and when said throttle valve is opened by more than a target throttle opening degree in the traction control.

15. The throttle control apparatus according to claim 2, further comprising:

motor-output increasing means for increasing an output of said motor when said accelerator pedal is abruptly depressed and when said limp home lever engages said accelerator lever.

16. The throttle control apparatus according to claim 15, wherein said motor-output increasing means increases a duty ratio of current flowing in said motor.

17. The throttle control apparatus according to claim 15, wherein said motor-output increasing means increases the output of said motor when said accelerator pedal is depressed by at least a predetermined depression distance when said accelerator pedal is depressed by at least a target depression speed and when said throttle valve is opened by less than a target throttle opening degree.

18. The throttle control apparatus according to claim 2, wherein said accelerator lever is further capable of auxiliarily helping opening of said throttle valve, controlled by said motor, when said accelerator pedal is abruptly depressed and when said limp home lever engages with said accelerator lever.

* * * * *